US005918370A

United States Patent [19]

Wells

[11] Patent Number: 5,918,370

[45] Date of Patent: Jul. 6, 1999

[54] HAND HELD POWER ASSISTED SHEARS

[75] Inventor: Andrew J. Wells, Bemidji, Minn.

[73] Assignee: Jarvis Products Corporation, Middletown, Conn.

[21] Appl. No.: 08/947,654

[22] Filed: Oct. 9, 1997

[51] Int. Cl.[6] ..... B26B 15/00; B26B 13/00; B26B 17/00

[52] U.S. Cl. ..... 30/228; 30/210; 173/161; 173/169; 173/170

[58] Field of Search ..... 30/228, 210; 173/161, 173/169, 170

[56] References Cited

U.S. PATENT DOCUMENTS

| | | | |
|---|---|---|---|
| 2,348,612 | 2/1944 | Deacon . | |
| 2,699,756 | 1/1955 | Miller . | |
| 2,743,707 | 5/1956 | Kellersman . | |
| 3,834,020 | 9/1974 | Caire . | |
| 3,837,076 | 9/1974 | Good, Jr. | 30/228 |
| 3,970,110 | 7/1976 | Schaedler et al. . | |
| 4,109,381 | 8/1978 | Pellenc . | |
| 4,136,445 | 1/1979 | Grubb | 30/228 |
| 4,206,603 | 6/1980 | Mekler . | |
| 4,359,821 | 11/1982 | Pellenc . | |
| 4,382,331 | 5/1983 | Kimura . | |
| 4,521,963 | 6/1985 | Lind et al. . | |
| 4,587,732 | 5/1986 | Lind et al. . | |
| 4,637,288 | 1/1987 | Olsen et al. . | |
| 4,756,220 | 7/1988 | Olsen et al. . | |
| 4,791,726 | 12/1988 | Ailey, Jr. . | |
| 4,949,461 | 8/1990 | van der Merve et al. . | |
| 4,967,474 | 11/1990 | Wells . | |
| 5,002,135 | 3/1991 | Pellenc . | |
| 5,105,543 | 4/1992 | Maarschalk et al. | 30/228 |
| 5,150,523 | 9/1992 | McCurry . | |
| 5,152,713 | 10/1992 | Baerltein | 30/228 |
| 5,172,479 | 12/1992 | Keeton . | |
| 5,272,811 | 12/1993 | Armand | 30/228 |
| 5,375,330 | 12/1994 | Herrmann . | |
| 5,476,119 | 12/1995 | Herrmann . | |

*Primary Examiner*—M. Rachuba
*Assistant Examiner*—Sean Pryor
*Attorney, Agent, or Firm*—DeLio & Peterson, LLC

[57] ABSTRACT

A hand held power assisted shears has a piston located in a cylinder formed in a pistol grip body. A trigger controls the position of a hollow shuttle spool rod which slides longitudinally within a hollow piston rod connected between the piston and the blades. The hollow shuttle spool rod carries pressurized working fluid to the piston where it is directed to the space above or below the piston. The piston drives the blades through the piston rod to a position corresponding to the position of the trigger allowing the operator to continuously control the position of the blades and the extent and rate of closure during cutting. The relative position of the shuttle spool rod and the piston rod controls whether the working fluid is directed above or below the piston to open or close the blades. One end of the shuttle spool rod acts as a piston which causes the blades to open automatically when the trigger is released. The blades and trigger may be removed without tools for cleaning the shears or sharpening the blades.

19 Claims, 4 Drawing Sheets

HAND HELD POWER ASSISTED SHEARS

BACKGROUND OF THE INVENTION

1. Field of the Invention

This invention is directed to hand held powered shears. More particularly, the invention relates to shears in which a pressurized working fluid is used to assist the operator by driving the blades with additional force as the operator controls the opening and closing of the blades.

2. Description of Related Art

There are many commercial processes requiring the use of a hand held shears to make repeated cuts. One such process is the dismemberment of poultry into its individual parts, and the present invention is particularly suited for this application, although it may also be used in many other types of cutting operations. To reduce operator fatigue, and increase the force that can be applied during cutting, the shears used in such processes are generally powered with a pressurized working fluid, such as compressed air.

One type of powered shears uses a trigger mechanism which, when depressed, causes the blades to close in a sudden single stroke. The trigger initiates the powered closing stroke, and once activated, the blades continue through the cutting cycle until fully closed. This type of shears is referred to herein as a "power operated shears". Although power operated shears are widely used, many operators prefer to have a shears where the opening and closing of the blades is totally and continuously under the operator's control.

To meet this demand, another type of shears has been developed, referred to herein as a "power assisted shears". Power assisted shears allow the operator to squeeze the blades shut or to open them, in a manner similar to the operation of a manually operated scissors, except that the blades are power driven to follow the motion of the operator's hand. This gives the operator much greater control by allowing the rate of closure and the extent of closure to be continuously adjusted during each cut.

Power assisted shears require a servo mechanism which follows the motion of the operator's hand, and which drives the blades to follow that motion. One difficulty with current designs, however, is in the placement and design of this servo mechanism. For example, U.S. Pat. No. 5,375,330 issued to Hermann on Dec. 27, 1994, discloses a power assisted shears with a servo mechanism that is externally mounted. This type of external servo mechanism has several exposed linkages which make it awkward to maneuver and difficult to clean. A smooth uncomplicated exterior on the tool is important in maintaining cleanliness and avoiding contamination during poultry or other food processing. Further, the external position of the servo requires numerous, relatively long, connecting parts and linkages which are difficult and expensive to manufacture.

Another problem with the design of some power assisted shears is that the operator must exert some force to open the blades before the power assistance of the servo mechanism is applied. The muscles used to open the hand tire much more rapidly than the muscles used to close the hand. Tools which require the operator to exert even a relatively low level of force to open the blades will fatigue the operator rapidly.

A final difficulty with earlier designs of power assisted shears has been the relatively difficult to disassemble connection between the blades, the trigger, the handle and the servo mechanism. This makes the blades difficult to remove for sharpening or replacement, and greatly decreases the likelihood of proper and thorough cleaning in the area around the trigger and blades where contamination is likely to occur.

Bearing in mind the problems and deficiencies of the prior art, it is therefore an object of the present invention to provide a power assisted shears in which the servo mechanism is substantially internal, protecting it from contamination and making the tool easy to clean.

Yet another object of the present invention is to provide a power assisted shears which opens automatically when the trigger is released.

It is another object of the present invention to provide a power assisted shears wherein the blades and trigger assembly can be quickly and easily removed for sharpening or replacement and so that the tool and its components can be rapidly and thoroughly cleaned.

A further object of the invention is to provide a power assisted shears wherein the arrangement of the trigger and the blades relative to each other and to the power driving mechanism is such as to minimize tool complexity and simplify construction of the tool.

Still other objects and advantages of the invention will in part be obvious and will in part be apparent from the specification.

SUMMARY OF THE INVENTION

The above and other objects, which will be apparent to those skilled in the art, are achieved in the present invention which is directed in a first aspect to a hand held power assisted shears including:

a body having a cylinder formed therein;

a pair of blades pivotally connected together for motion between an open and a closed position;

a piston located within the cylinder and sliding longitudinally therein, the piston dividing the cylinder into first and second chambers on opposite sides of the piston;

a piston rod having a first end connected to the piston and a second end connected to drive at least one of the blades;

a shuttle spool rod sliding longitudinally relative to the piston rod, the shuttle spool rod including a pressure passageway, an exhaust passageway, a pressure outlet, connected to the pressure passageway, and an exhaust inlet, connected to the exhaust passageway;

a fluid inlet adapted for connection to a source of pressurized working fluid, the fluid inlet directing working fluid into the pressure passageway of the shuttle spool rod; and a trigger pivoted for motion between a shears closed and a shears open position, the trigger being connected to the shuttle spool rod for sliding the shuttle spool rod relative to the piston rod, the pivoting trigger moving the shuttle spool rod to connect the pressure outlet to the first chamber and the exhaust inlet to the second chamber when the trigger is pivoted towards the shears closed position;

the shuttle spool rod being driven by the working fluid to connect the exhaust inlet to the first chamber and the pressure outlet to the second chamber when the trigger is released.

In the preferred design, the piston is provided with at least one passageway and the pressure outlet and exhaust inlet cooperatively interact with that passageway to connect the pressure outlet to the first chamber when the trigger is pivoted towards the shears closed position and to connect the exhaust inlet to the first chamber when the trigger is released.

In order to cause the shears to open automatically when the trigger is released, a second cylinder is formed in the body. The shuttle spool rod is constructed with an enlarged end forming a second piston positioned in the second cylinder, and the pressurized fluid is directed into the second cylinder to continuously urge the shuttle spool rod towards the position that causes the blades to open.

In the most highly preferred design, the shears is arranged such that it can be operated even when a source of pressurized working fluid is not connected to the tool. This is accomplished by restricting the range of relative longitudinal motion between the shuttle spool rod and the piston rod. The trigger moves the shuttle spool rod which drives the piston rod at the limits of the restricted relative range of motion. This feature also allows the operator to add the force that can be applied by hand through the trigger to the force provided by the working fluid through the piston.

In a further aspect of the invention, the hand held power assisted shears includes:

a body having a cylinder and a recess formed therein;

a cover for covering the recess;

a pair of blades pivoted on a blade pivot and held in the recess;

a piston located within the cylinder and sliding longitudinally therein, the piston dividing the cylinder into first and second chambers on opposite sides of the piston;

a hollow piston rod including:

a first end connected to the piston, and a second end connected to drive at least one of the blades;

a shuttle spool rod located within the hollow piston rod and sliding longitudinally therein over a limited range;

a fluid inlet adapted for connection to a source of pressurized working fluid; a plurality of interacting passageways in the shears for directing pressurized working fluid to the first chamber when the shuttle spool rod is in a first position relative to the piston rod and for directing pressurized working fluid to the second chamber when the shuttle spool rod is in a second position relative to the piston rod; and a trigger pivoted on a trigger pivot and held in the recess, the trigger engaging the shuttle spool rod to move the shuttle spool rod relative to the piston rod to operate the shears;

the cover holding the trigger and blades in the recess, and the blades and the trigger being easily disengageable from the piston rod and the shuttle spool rod for cleaning when the cover is removed.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–6 of the drawings in which like numerals refer to like features of the invention.

Figure 1:
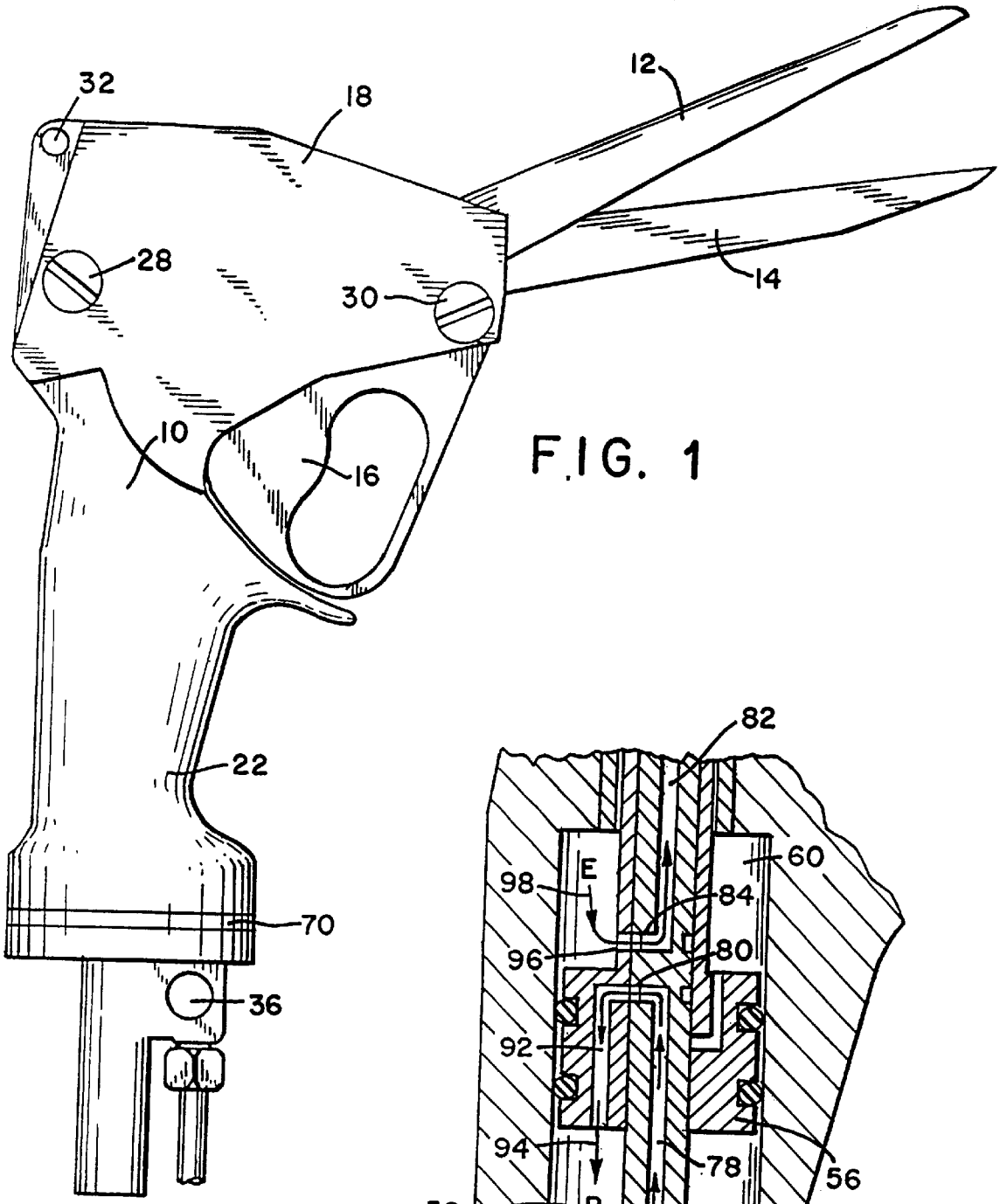
FIG. 1 provides a side elevational view of the preferred embodiment of the power assisted shears of the present invention.

Referring principally to FIG. 1, the power assisted shears of this invention has body 10, a pair of blades including a driven blade 12 and a fixed blade 14, a rigger 16 and a cover 18.

Figure 2:
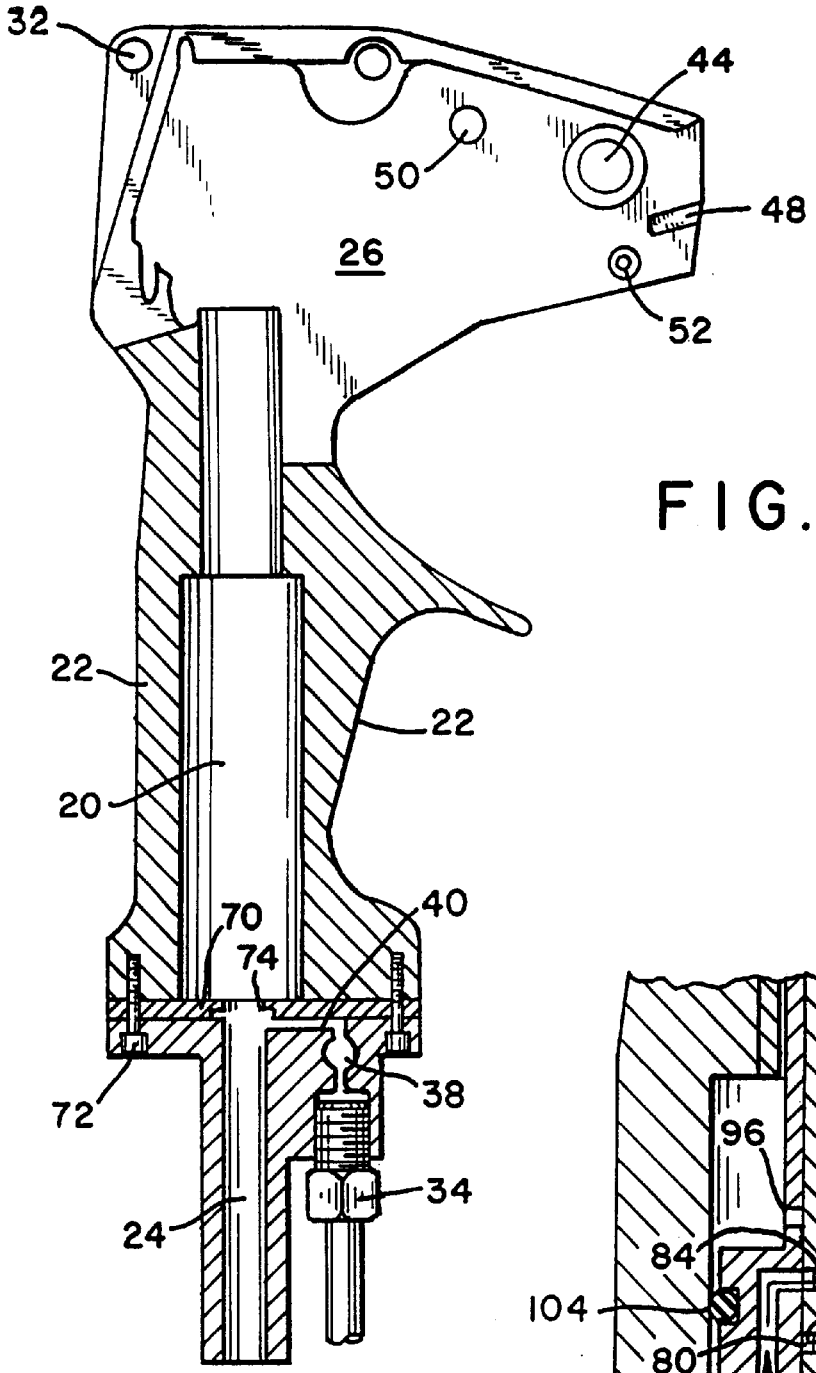
FIG. 2 provides a side elevational view, partially in cross section, of the body portion of the power assisted shears shown in FIG. 1. The cover, blades, trigger and all pistons and rods have been removed in this view.

FIG. 2 shows the body portion in cross section, with the cover 18 and blades 12, 14 removed. The body includes a first cylinder 20 formed inside the pistol grip portion 22 of the body 10 and a second cylinder 24 which is axially aligned with the first cylinder 20. The pistol grip is held in the palm of the hand and the fingers fall easily around the trigger 16 where it may be squeezed to close the blades or released to open the blades.

The upper portion of the body 10 includes a recess 26 which is enclosed by cover 18 to protect against contamination. Cover 18 is attached to the body by threaded and knurled knobs 28, 30 seen in FIG. 1. The knobs 28, 30 are easily unscrewed by the operator to release the cover. This provides rapid access to the blades and the trigger found within recess 26 so that this area may be cleaned. The simplicity and ease of access to this area of potential contamination encourages the operator to maintain tool cleanliness, which is important in a food processing operation. The relatively smooth exterior of the tool, as seen in FIG. 1, also helps to maintain the sanitary condition of the tool.

As will be described below, when the cover is removed, the trigger and blades may simply be lifted out without removing any additional fasteners and without the use of any tools. This further simplifies the task of cleaning the recess area 26 and allows a rapid change of blades to a replacement set of sharpened blades. Opening 32 is provided so that the tool may be suspended near the operator.

A fluid inlet 34 is provided to connect the tool to a source of pressurized working fluid. Typically, the fluid used will be compressed air, however, other types of working fluid may be substituted. In the preferred embodiment, the pressurized working fluid passes from the fluid inlet 34 through a safety valve 36 seen in FIG. 1. The safety valve 36 operates in conjunction with opening 38 as seen in FIG. 2 to turn on or turn off the pressurized working fluid. When the safety valve 36 is turned on, pressurized working fluid passes through opening 38 and through passageway 40 into the second cylinder 24 before it is directed to power the tool.

Figure 3:
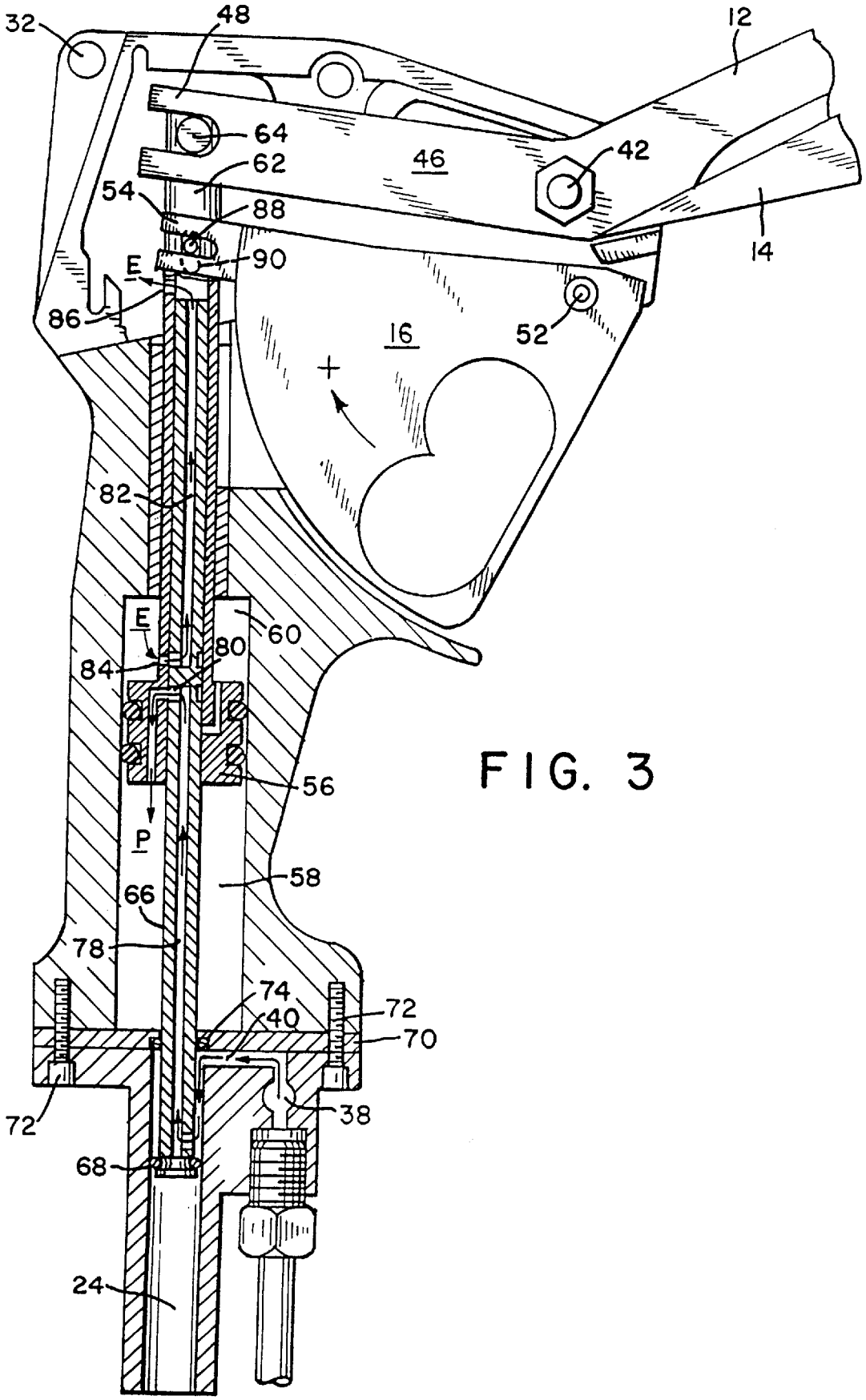
FIG. 3 provides a side elevational view, partially in cross section, of the power assisted shears shown in FIG. 1, with the cover removed. The tool is shown with its operating components as they appear when the trigger is being squeezed and the blades are being closed.

The blades 12, 14 are held together by a blade pivot 42, shown in FIG. 3, which holds the blades together as a pivoted pair when the blades are removed. The blade pivot 42 is not threaded into or otherwise permanently attached to the body. Instead the blade pivot projects out from each side of the blade pair. This outward projection on each side of the blades is held between corresponding recesses in the cover and in the body.

The blade pivot recess 44 formed in the body can be seen in FIG. 2. This arrangement suspends the blade pivot between a recess in the cover 18 and the blade recess 44 in the body when the cover 18 is secured. The blades are held on the trapped pivot during use, and may freely pivot relative to each other as the blades open and close, but as soon as the cover is removed, the blades may simply be lifted out of the recess 26.

The moveable blade 12 includes a rearward projection 46 seen in FIG. 3. The rearward projection 46 includes a blade fork 48 at its rearward end which is driven to open and close the blades. The fixed blade 14 is held stationary relative to the body 10 by a pin 50 which engages a corresponding hole (not shown) in fixed blade 14. A shelf 48 and the general fit of the fixed blade in the recess also serves to hold the fixed blade in position when the cover is attached. With the cover removed, the fixed blade is lifted out of the recess with the movable blade. As it is lifted, the pin 50 is disengaged from the fixed blade.

Referring to FIG. 3, the trigger 16 pivots about a trigger pivot 52 which is positioned close to the blade pivot 42. Trigger 16 includes a trigger fork 54 which is positioned below and near the blade fork 48.

Figure 4:
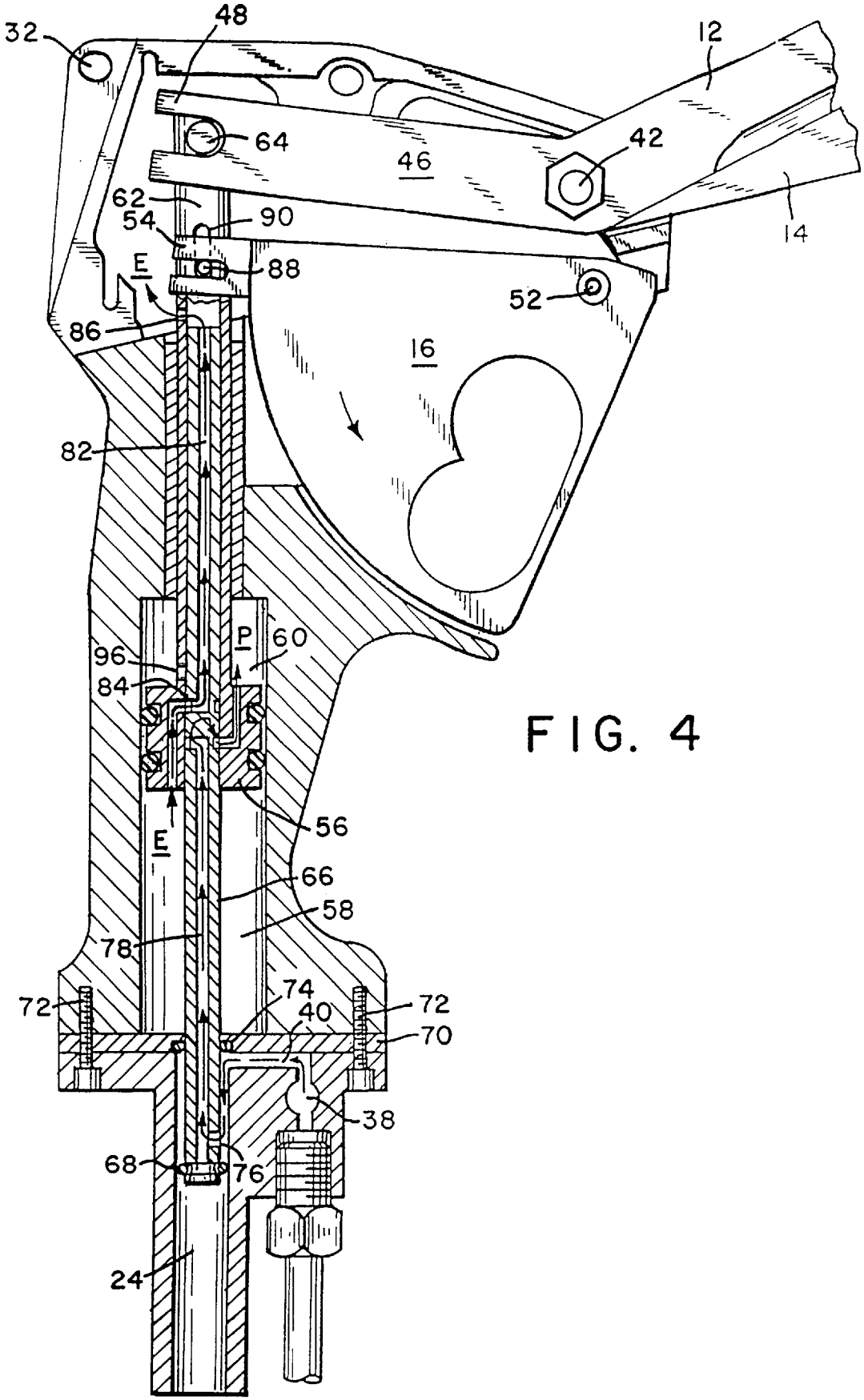
FIG. 4 provides a side elevational view, partially in cross section, substantially as shown in FIG. 3, except that the tool is shown with its operating components as they appear when the trigger has been released and the blades are opening.

As can be seen in FIGS. 3 and 4, the relative positions of trigger pivot 52, blade pivot 42, trigger fork 54 and blade fork 48 are such that the trigger and the rearward projection 46 of the moveable blade 12 remain in approximately parallel alignment as the trigger is operated. This parallel alignment provides for a simple design in which the connections between the trigger, the blades, and the power systems are simple and quite short, as well as being completely internal to the tool. This makes for an inexpensive yet highly reliable mechanism.

The trigger 16 is held in place by the cover 18, and in particular by knob 30 which engages a threaded interior of the trigger pivot 52. With the cover 18 removed, the trigger 16 may be lifted off the trigger pivot 52, leaving the recess 26 completely open for cleaning.

The driven blade 12 is operated by piston 56 which is located within the first cylinder 20 and which divides the first cylinder into a first (lower) chamber 58 and a second (upper) chamber 60. The piston 56 drives the blade fork 48 through a hollow piston rod 62. The piston rod 62 has a first end connected to the piston 56 and a second end containing a pin 64 which engages the blade fork 48.

When pressurized working fluid is directed into the first chamber 58, it forces the piston 56 to the upper end of the first cylinder and closes the blades. When pressurized fluid is directed into the second chamber above the piston, it forces the piston to the bottom end of cylinder 20 and opens the blades.

Trigger 16 controls the flow of the working fluid between the two sides of the first piston 56 by sliding a shuttle spool rod 66 relative to the piston rod 62. The shuttle spool rod 66 is hollow and slides longitudinally within the hollow piston rod. The hollow interior of the shuttle spool rod carries the pressurized working fluid from the second cylinder 24 to the piston where it is steered into either the first or second cylinder according to the position of the trigger and the relative position of the shuttle spool rod and the piston rod. The shuttle spool rod extends from an upper end near the trigger fork 54 to a lower end which slides within the second chamber 24.

The hollow interior of the shuttle spool rod 66 is blocked at its lower end and near its center. The lower end of the spool rod is enlarged by an O ring 68 which forms a sliding piston within the second cylinder 24. The diameter of the shuttle spool rod 66 is just slightly less than the diameter of cylinder 24 so that the working fluid introduced near the upper end of cylinder 24 is free to flow around the outer surface of the shuttle spool rod, between that surface and the inner surface of the second cylinder 24.

A sealing plate 70 is held in position by screws 72 which also serve to attach the lower half of the body containing cylinder 24. The sealing plate 70 has an opening 74 of substantially the same diameter as the diameter of the shuttle spool rod 66. Opening 74 forms a seal around shuttle spool rod 66. Pressurized air flows from passageway 40 into the space around the shuttle spool rod within the second cylinder 24 where it is trapped between the seal formed by opening 74 and the seal formed by the piston-like O ring 68. The working fluid escapes from the second cylinder through a pressure inlet 76 into the hollow lower portion of the shuttle spool rod 66 which forms pressure passageway 78.

Pressurized working fluid flows from the pressure inlet 76, up the pressure passageway 78 and out a pressure outlet 80 located in the vicinity of the piston 56. The relative position of the pressure outlet 80 and the piston 56 controls whether the pressurized working fluid is directed to the first chamber 58 or the second chamber 60 and thereby controls whether the blades are being driven towards the open or closed position. Trigger 16 controls this relative positioning by sliding the shuttle spool rod 66 relative to the piston rod 66 to control the relative position between the pressure outlet 80 and the piston 56.

As will be understood from the preceding description of the second chamber 24, pressurized working fluid that is trapped around the exterior of the shuttle spool rod in cylinder 24 tends to constantly drive the shuttle spool rod towards the lower end of that cylinder. This action continuously urges the shuttle spool rod into the position relative to the piston rod that causes the blades to move towards the open position. This tendency for the shuttle spool rod to slide towards the bottom end of cylinder 24 is easily overcome by the operator when he squeezes the trigger 16 and the shuttle spool rod upwards. The difference in diameter between the shuttle spool rod 66 and the second cylinder 24 is minimized so that the force produced on the shuttle spool rod is just sufficient to cause the desired self-opening characteristic in the tool.

The upper end of the shuttle spool rod 66 is also substantially hollow and forms exhaust passageway 82. Exhaust passageway 82 includes an exhaust inlet 84 located near the center of the shuttle spool rod and an exhaust outlet 86 located near the upper end of the shuttle spool rod. The uppermost end of the shuttle spool rod includes a pin 88 which engages the trigger fork 54 to make the connection to trigger 16. When trigger 16 is squeezed, it pivots about trigger pivot 52 and slides the shuttle spool rod 66 in an upwards direction relative to the piston rod 62. When the trigger is released, the pressurized working fluid in chamber 24 pushes the shuttle spool rod in the opposite direction. The relative motion between the shuttle spool rod 66 and the piston rod 52 is limited by the pin 54 which projects through a slot 90 in the piston rod 62.

The slot 90 on the piston rod acts as a motion restrictor which cooperates with the pin 88 acting as a restrictor element to limit the relative motion between the shuttle spool rod 66 and the piston rod 62. Because of this restricted range of relative motions, the trigger between the trigger pivot 52 and the trigger fork 54 maintains a relatively constant relationship with the driven blade between the blade pivot 52 and the blade fork 48.

Furthermore, this restricted range of motion allows the blades to be opened or closed by the trigger 16 even when a source of pressurized working fluid is not attached to the tool. The trigger 16 when squeezed pulls the pin 88 to the upper end of the slot 90 and then forces the piston rod upwards closing the blades. This position is shown in FIG. 3 with the pin 88 at the upper end of the slot 90. This will be referred to hereinafter as the first relative position. FIG. 4 is substantially the same as FIG. 3 except that the blades are in the process of being opened by the absence of any force applied to trigger 16. Pressurized working fluid located in the second chamber 24 is forcing the shuttle spool rod downward, moving the pin 88 to the bottom end of slot 90. This position is referred to as second relative position hereinafter.

At a point approximately midway between the first relative position and the second relative position, is an intermediate position. In this position, the flow of pressurized fluid is blocked and the blades remain stationary. Due to the self-opening design of the tool, however, the trigger needs to be held in this position to hold the blades in the corresponding position.

Figure 5:
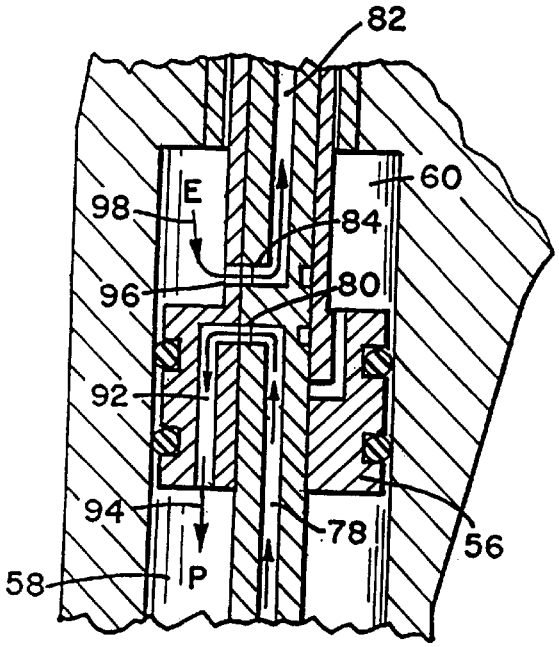
FIG. 5 is a detail cross sectional view of a portion of the power assisted shears shown in FIG. 3 illustrating the fluid flow which occurs in the piston, piston rod and shuttle spool rod when the blades are being closed.
Figure 6:
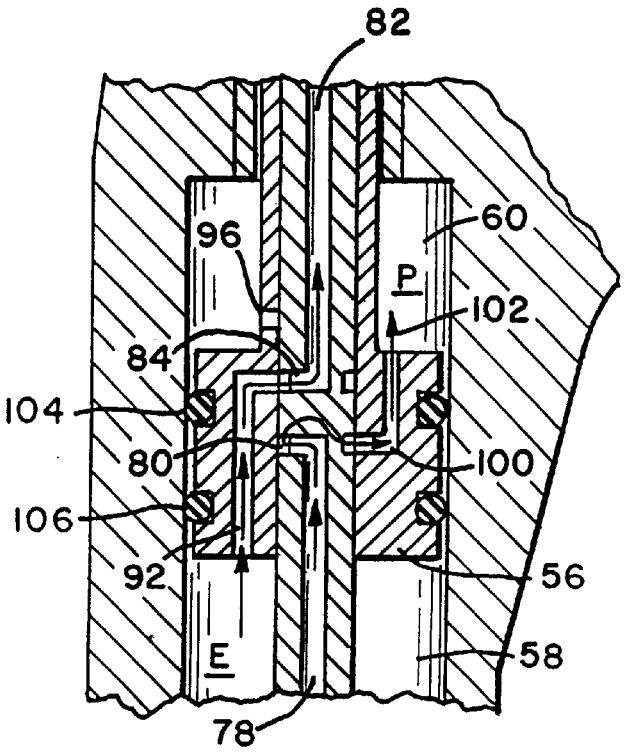
FIG. 6 is a detail cross sectional view of a portion of the power assisted shears shown in FIG. 4 illustrating the fluid flow which occurs in the piston, piston rod and shuttle spool rod when the blades are opening.

A more detailed understanding of the flow of pressurized fluid and the operation of the tool may be obtained by referring to the enlarged partial views in FIGS. 5 and 6. FIG. 5 corresponds to FIG. 3 and illustrates the shuttle spool rod in the first position relative to the piston rod where the trigger 16 is being squeezed. In this position, the slight downward force provided by the second cylinder 24 has been overcome by the operator, the shuttle spool rod is in the first position relative to the piston rod. Pressurized working fluid in the pressure passageway 78 flows out of the pressure outlet 80 and into passageway 92 in piston 56 where it is directed into the first chamber 58 as shown by arrow 94.

At the same time as the first chamber is being pressurized, the exhaust inlet 84 has been aligned with opening 96 in the piston rod. This allows working fluid in the second chamber 60 to be exhausted into the exhaust passageway 82 as shown by arrow 98.

When trigger 16 is released, the shuttle spool rod moves to the second position relative to the piston rod as shown in FIG. 6. In this relative position, the pressure outlet 80, which includes outlets on both sides of the piston rod, becomes aligned with passageway 100 in the piston 56 directing pressurized working fluid into the second chamber 60 as shown by arrow 102.

In the second relative position, when the second chamber is being pressurized, the first chamber 58 is exhausted through passageway 92 which is aligned with the exhaust inlet 84.

The two passageways 92, 100 in the piston 56 interact with the pressure outlet 80 to alternately direct pressurized working fluid to the first and second chambers as controlled by the trigger and the relative position between the shuttle spool rod and the piston rod. The piston 56 is sealed to the interior walls of the first cylinder by piston rings 104 and 106.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A hand held power assisted shears comprising:

a body having a cylinder formed therein;

a pair of blades pivotally connected together for motion between an open and a closed position;

a piston located within the cylinder and sliding longitudinally therein, the piston dividing the cylinder into first and second chambers on opposite sides of the piston;

a piston rod having a first end connected to the piston and a second end connected to drive at least one of the blades;

a shuttle spool rod sliding longitudinally relative to the piston rod, the shuttle spool rod including:

a pressure passageway, an exhaust passageway, a pressure outlet, connected to the pressure passageway, and an exhaust inlet, connected to the exhaust passageway;

a fluid inlet adapted for connection to a source of pressurized working fluid, the fluid inlet directing working fluid into the pressure passageway of the shuttle spool rod; and a trigger pivoted for motion between a shears closed and a shears open position, the trigger engaging to the shuttle spool rod for sliding the shuttle spool rod relative to the piston rod, the pivoting trigger moving the shuttle spool rod to connect the pressure outlet to the first chamber and the exhaust inlet to the second chamber when the trigger is pivoted towards the shears closed position;

the shuttle spool rod being driven by the working fluid to connect the exhaust inlet to the first chamber and the pressure outlet to the second chamber when the trigger is released.

2. A hand held power assisted shears according to claim 1 wherein the pressure outlet and exhaust inlet cooperatively interact with at least one passageway in the piston to connect the pressure outlet to the first chamber when the trigger is pivoted towards the shears closed position and the exhaust inlet to the first chamber when the trigger is released.

3. A hand held power assisted shears according to claim 1 wherein the body has a second cylinder formed therein, the shuttle spool rod has an enlarged end forming a second piston slidingly positioned in the second cylinder, and the pressurized fluid is directed into the second cylinder to continuously urge the shuttle spool rod towards the second relative position.

4. A hand held power assisted shears according to claim 3 wherein the enlarged end of the shuttle spool rod is formed by a seal on the shuttle spool rod.

5. A hand held power assisted shears according to claim 4 wherein the seal is an "O" ring seal.

6. A hand held power assisted shears according to claim 1 wherein the shuttle spool rod moves longitudinally relative to the piston rod only over a restricted range, the trigger driving the piston rod to operate the shears when a source of pressurized working fluid is not connected to the fluid inlet.

7. A hand held power assisted shears according to claim 6 wherein the range of motion between the shuttle spool rod and the piston rod is restricted by a slot in the piston rod and a pin on the shuttle spool rod, the pin projecting through the slot and being engaged by the trigger.

8. A hand held power assisted shears according to claim 7 wherein the blades include a fork engaging a pin on the piston rod and the trigger includes a fork engaging the pin on the shuttle spool rod.

9. A hand held power assisted shears according to claim 1 wherein the blades are pivoted about a blade pivot, and the trigger is pivoted about a trigger pivot located near the blade pivot, the relative location of the blade pivot and the trigger pivot maintaining the trigger and the at least one blade in approximate alignment as the trigger is operated.

10. A hand held power assisted shears according to claim 1 wherein the body includes a recess for holding the trigger and the blades, the recess being covered by a cover, and the trigger and the blades may be disengaged and removed for cleaning when the cover is removed.

11. A hand held power assisted shears according to claim 10 wherein the trigger is held on a trigger pivot and the cover is held in place by a fastener engaged to the trigger pivot, the fastener also holding the trigger on the trigger pivot when the shears is used.

12. A hand held power assisted shears comprising:

a body having a cylinder formed therein;

a pair of blades pivoted on a blade pivot for motion between an open and a closed position;

a piston located within the cylinder and sliding longitudinally therein, the piston dividing the cylinder into first and second chambers on opposite sides of the piston;

a piston rod including:

a first end connected to the piston, and a second end connected to drive at least one of the blades;

a shuttle spool rod slidingly connected to the piston rod for limited longitudinal motion relative to the piston rod over a range between a first position through an intermediate position to a second position;

a fluid inlet adapted for connection to a source of pressurized working fluid;

a plurality of interacting passageways in the shears for directing pressurized working fluid to the first chamber when the shuttle spool rod is in the first position relative to the piston rod and for directing pressurized working fluid to the second chamber when the shuttle spool rod is in the second position relative to the piston rod; and a trigger pivoted around a trigger pivot located near the blade pivot, the trigger contacting the shuttle spool rod at a location near the second end of the piston rod to maintain the trigger and the at least one blade in approximate alignment, the trigger sliding the shuttle spool rod relative to the piston rod to control the operation of the power assisted shears when a source of pressurized working fluid is connected to the fluid inlet, the trigger operating the shears manually when a source of pressurized working fluid is not connected to the fluid inlet by driving the piston rod through the shuttle spool rod.

13. A hand held power assisted shears according to claim 12 further including:

a motion restrictor on the piston rod; and a restrictor element on the shuttle spool rod;

and wherein the trigger engages the restrictor element to move the shuttle spool rod, the restrictor element and the motion restrictor cooperating to limit the relative longitudinal motion between the shuttle spool rod and the piston rod and to maintain the approximate alignment of the trigger and the blade.

14. A hand held power assisted shears according to claim 13 wherein:

the motion restrictor on the piston rod is a slot, the restrictor element on the shuttle spool rod comprises a pin projecting through the slot, and the trigger engages the pin to move the shuttle spool rod.

15. A hand held power assisted shears according to claim 12 further including means for continuously urging the shuttle spool rod from the intermediate relative position towards the second relative position.

16. A hand held power assisted shears according to claim 15 wherein the means for continuously urging the shuttle spool rod includes a second cylinder receiving an end of the shuttle spool rod, the pressurized working fluid in the second cylinder continuously urging the shuttle spool rod towards the second relative position.

17. A hand held power assisted shears according to claim 12 wherein:

the body has a second cylinder formed therein, the shuttle spool rod has an enlarged end forming a second piston slidingly positioned in the second cylinder, and the pressurized fluid is directed into the second cylinder to continuously urge the shuttle spool rod towards the second relative position.

18. A hand held power assisted shears comprising:

a body having a cylinder and a recess formed therein;

a cover for covering the recess;

a pair of blades pivoted on a blade pivot and held in the recess;

a piston located within the cylinder and sliding longitudinally therein, the piston dividing the cylinder into first and second chambers on opposite sides of the piston;

a hollow piston rod including:

a first end connected to the piston, and a second end connected to drive at least one of the blades;

a shuttle spool rod located within the hollow piston rod and sliding longitudinally therein over a limited range;

a fluid inlet adapted for connection to a source of pressurized working fluid;

a plurality of interacting passageways in the shears for directing pressurized working fluid to the first chamber when the shuttle spool rod is in a first position relative to the piston rod and for directing pressurized working fluid to the second chamber when the shuttle spool rod is in a second position relative to the piston rod; and a trigger pivoted on a trigger pivot and held in the recess, the trigger engaging the shuttle spool rod to move the shuttle spool rod relative to the piston rod to operate the shears;

the cover holding the trigger and blades in the recess, and the blades and the trigger being easily disengageable from the piston rod and the shuttle spool rod for cleaning when the cover is removed.

19. A hand held power assisted shears according to claim 18 wherein the at least one blade has a fork at one end engaging a pin on the piston rod, and the trigger has a fork engaging a pin on the shuttle spool rod.

* * * * *

UNITED STATES PATENT AND TRADEMARK OFFICE

CERTIFICATE OF CORRECTION

PATENT NO. : 5,918,370

DATED : July 6, 1999

INVENTOR(S) : Andrew J. Wells

It is certified that error appears in the above-identified patent and that said Letters Patent is hereby corrected as shown below:

In column 4, line 24, delete "rigger" and substitute therefor - - trigger - -.

Signed and Sealed this

Sixteenth Day of November, 1999

*Attest:*

*Attesting Officer*

Q. TODD DICKINSON

*Acting Commissioner of Patents and Trademarks*